US006943320B1

(12) United States Patent
Bavett

(10) Patent No.: US 6,943,320 B1
(45) Date of Patent: Sep. 13, 2005

(54) RUBBERIZED COVERING WITH INTEGRAL HEATING SYSTEM

(76) Inventor: Steven T. M. Bavett, 2809 Orchard Lakes Dr., Baldwin, MD (US) 21013

( * ) Notice: Subject to any disclaimer, the term of this patent is extended or adjusted under 35 U.S.C. 154(b) by 0 days.

(21) Appl. No.: 10/790,546

(22) Filed: Mar. 1, 2004

(51) Int. Cl.[7] ..... H05B 1/00
(52) U.S. Cl. ..... 219/213; 219/528; 219/548
(58) Field of Search ..... 219/213, 548, 219/528, 539, 545

(56) References Cited

U.S. PATENT DOCUMENTS

| | | | | | |
|---|---|---|---|---|---|
| 2,745,942 | A | * | 5/1956 | Cohen | 219/528 |
| 2,844,696 | A | | 7/1958 | Custer, Jr. | 219/19 |
| 3,418,448 | A | * | 12/1968 | Pradenas | 219/213 |
| 3,445,628 | A | * | 5/1969 | Bateman, Sr. | 392/436 |
| 3,806,702 | A | | 4/1974 | Spencer | 219/528 |
| 4,564,745 | A | * | 1/1986 | Deschenes | 219/213 |
| 4,817,707 | A | | 4/1989 | Aoyama et al. | 165/46 |
| 4,922,084 | A | * | 5/1990 | Hutter | 219/549 |
| 4,967,057 | A | * | 10/1990 | Bayless et al. | 219/213 |
| 5,380,988 | A | * | 1/1995 | Dyer | 219/548 |
| 5,550,350 | A | * | 8/1996 | Barnes | 219/213 |
| 5,591,365 | A | * | 1/1997 | Shields | 219/213 |
| 5,614,292 | A | | 3/1997 | Saylor | 428/209 |
| 5,637,247 | A | | 6/1997 | Flynn, Jr. | 219/213 |
| 5,765,779 | A | | 6/1998 | Hancock et al. | 244/134 |
| 5,786,563 | A | | 7/1998 | Tiburzi | 219/213 |
| 5,854,470 | A | | 12/1998 | Silva | 219/528 |
| 6,051,811 | A | | 4/2000 | Hardison | 219/213 |
| 6,180,929 | B1 | * | 1/2001 | Pearce | 219/528 |
| 6,184,496 | B1 | | 2/2001 | Pearce | 219/213 |
| 6,211,493 | B1 | | 4/2001 | Bouman | 219/213 |
| 6,278,085 | B1 | | 8/2001 | Abukasm | 219/213 |
| 6,294,768 | B1 | * | 9/2001 | Liebich | 219/528 |
| 6,438,909 | B2 | * | 8/2002 | Birch et al. | 52/182 |
| 2003/0006229 | A1 | | 1/2003 | Lin et al. | 219/528 |

* cited by examiner

*Primary Examiner*—Tu Ba Hoang
*Assistant Examiner*—Vinod Patel
(74) *Attorney, Agent, or Firm*—Armstrong, Kratz, Quintos, Hanson & Brooks, LLP

(57) ABSTRACT

A heating system providing a heated surface for use on or in a driveway, roadway, walkway, patio, deck, stairs or the like, principally for outdoor use but usable as well for indoor use. The heating system includes a form suitably retained on an existing surface, at least one block disposed within the form, the block being molded principally of recycled rubber, thereby providing a frictional surface to prevent or minimize slipping. The heating system also includes heating elements for heating the block, thereby providing substantially improved moisture absorption and evaporation along with substantially improved melting capacity for ice or snow, and the block being removably disposed in the form for substantially easier and convenient repair, thus avoiding the necessity for digging up any concrete, asphalt or other materials.

9 Claims, 9 Drawing Sheets

RUBBERIZED COVERING WITH INTEGRAL HEATING SYSTEM

BACKGROUND OF THE INVENTION

1. Technical Field

The present invention relates to a heated covering, and more particularly, relates to a rubberized heated covering with an integral heating system.

2. Related Art

When snow accumulates on a concrete sidewalk, it may be considered a hazard which causes pedestrians to slip and become injured. A heating system may be used to heat concrete sidewalks, and thus prevent an accumulation of snow. One example of such a heating system includes heating elements which are embedded in the concrete. The heating elements can include electrically conductive portions, for example.

However, such heated concrete sidewalks can have disadvantages. A first disadvantage of heated concrete sidewalks becomes apparent when the heating elements cease to function properly, because the entire concrete slab must be broken up and removed in order to gain access to the heating system. During the process of breaking up the concrete slab, the heating system embedded therein may be permanently destroyed. As a result, the heating system cannot be repaired. Instead, a new replacement heating system must be purchased, installed, and tested. Also, of course, the concrete must be replaced. The replacement of the entire heating system and concrete can be expensive and time consuming.

A second disadvantage of heated concrete sidewalks relates to the fact that they do not inherently provide a walking surface which is water-absorbing, slip-resistant, and cost-effective.

SUMMARY OF THE INVENTION

The present invention solves the above-described disadvantages regarding the heated concrete sidewalks by providing a rubberized slip-resistant water-absorbing covering with an integral heating system. The rubberized covering of the present invention may be utilized on driveways, road surfaces, stairs, paths, and other areas.

The rubberized covering of the present invention includes a surface material which is heated by heating elements. The surface material can be formed in one large sheet or in a group of small individual blocks. If there is ever a problem with the heating elements, the large sheet or the small blocks can be removed in order to gain easy access the heating elements. Thus, the heating elements may be repaired, and then the large sheet or small blocks can be replaced.

In accordance with the principles of the present invention, the large sheet or small blocks are placed into a pan. The heavy weight of the sheet or blocks can hold them in place in the pan. Also, fasteners may be used to hold the sheet or blocks in the pan. The sheet or blocks, in combination with the pan, results in a slip-resistant heated surface that is strong and durable enough to withstand a high volume of highway automobile and truck traffic, and a high volume of pedestrian traffic. The pan may be referred, to as a frame, form, or tray.

In accordance with the principles of the present invention, as embodied and broadly described, the heating elements can be located beneath the surface material and/or in channels formed in the surface material. If a heating element is damaged, and that heating element is located in a channel in a small individual block of the surface material, that small individual block can be easily and inexpensively removed and discarded. Afterwards, a new small individual block can be installed in its place, to thereby cause the entire heating system to function properly again. In this manner, the present invention can help to avoid expensive and time-consuming repairs and reinstallations.

The surface material used in the present invention can include recycled rubber tires. The recycled rubber tires can provide an inexpensive non-skid or non-slip surface.

In accordance with the principles of the present invention, as embodied and broadly described, a first embodiment of the present invention provides, in combination, a heated driveway, walkway, patio, deck, stairs or the like principally for outdoor use but usable as well for indoor use, the combination comprising a form suitably retained on an existing surface, at least one block disposed within the form, the block being molded principally of recycled rubber, thereby providing a frictional surface to prevent or minimize slipping, and electrical means for heating the block, thereby providing substantially improved moisture absorption and evaporation along with substantially improved melting capacity for ice or snow, and the block being removably disposed in the form for substantially easier and convenient repair, thus avoiding the necessity for digging up any concrete or masonry materials.

In accordance with the principles of the present invention, as embodied and broadly described, the present invention provides a method of installing a heated driveway, walkway, patio, deck, stairs or the like, using the combination of the first embodiment of the present invention.

In accordance with the principles of the present invention, as embodied and broadly described, the present invention provides, in a heated driveway, walkway, patio, deck, stairs or the like, a plurality of blocks disposed on top of the walkway, patio, deck, stairs or the like, each of the blocks being molded from a material providing a frictional top surface to prevent slipping, means for heating the blocks, thereby melting snow, freezing rain or ice on top of the blocks, and means for detecting and locating any fault in the heating means that may subsequently occur, so that a block or a few blocks may be lifted up to provide access to the fault in the heating means for a relatively quick and convenient repair thereto.

In accordance with the principles of the present invention, as embodied and broadly described, the present invention provides, in combination, a molded sheet adapted to be placed over a given surface of a driveway, walkway or patio, the sheet having a frictional top surface to prevent slipping when walking over the sheet, a heating means disposed between the given surface and the sheet, the sheet being sufficiently heavy so that no bonding between the sheet and the given surface is necessary, and so that the sheet may be merely lifted up to make repairs or replace the heating means without the necessity of digging up any concrete, asphalt, or the like.

In accordance with the principles of the present invention, as embodied and broadly described, the present invention provides, an apparatus radiating heat, the apparatus including a heated slip-resistant surface, the apparatus comprising: a pan having a bottom region; a sheet being removably positioned on the bottom region of said pan, said sheet having the slip-resistant surface; and a heating element heating the slip-resistant surface of said sheet.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DESCRIPTION OF BEST MODE OF CARRYING OUT THE INVENTION

While the present invention will be described more fully hereinafter with reference to the accompanying drawings, in which details of the present invention are shown, it is to be understood at the outset of the description which follows that persons of skill in the appropriate arts may modify the invention here described while still achieving the favorable results of this invention. Accordingly, the description of the best mode contemplated of carrying out the invention, which follows, is to be understood as being a broad, teaching disclosure directed to persons of skill in the appropriate arts, and not as limiting upon the present invention.

Illustrative embodiments of the best mode of carrying out the invention are described below. In the interest of clarity, not all features of an actual implementation are described. In the following description, well-known functions, constructions, and configurations are not described in detail since they could obscure the invention with unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

Figure 1:
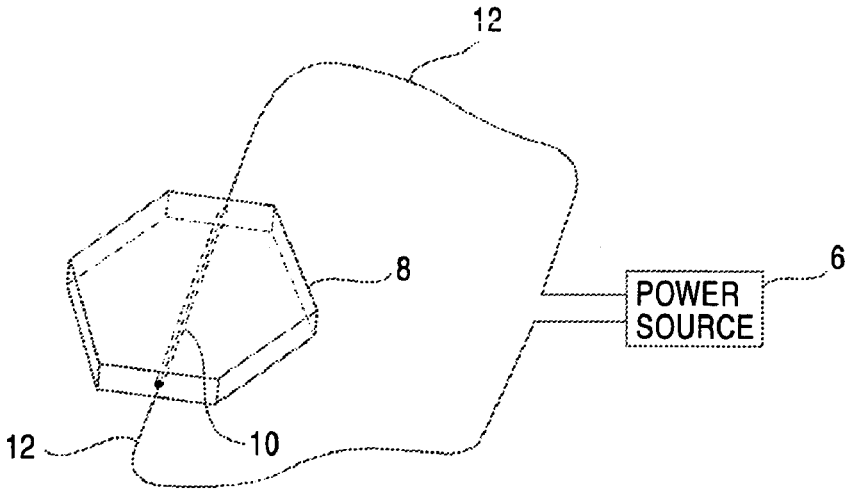
FIG. 1 shows a view of a hexagon-shaped individual rubber block with one channel through the body of the block, in accordance with the principles of the present invention.

FIG. 1 shows a view of a hexagon-shaped individual rubber block with one channel through the body of the block, in accordance with the principles of the present invention. As shown in FIG. 1, the individual rubber block 8 has a hexagon shape, and has a channel 10 formed through the interior body of block 8. A wire 12 is positioned inside the channel 10. A power source 6 conveys electricity through wire 12. When the electricity is conveyed through wire 12, the wire 12 heats up because wire 12 acts like a resistor. Wire 12 is not a perfect conductor, so some energy is converted to heat which causes a temperature of wire 12 to rise. When the temperature of wire 12 rises, this causes the temperature of the interior of block 8 to rise. As a result, block 8 will radiate heat and melt snow.

The individual rubber block 8 may be formed so that it will have a slip-resistant or skid-resistant surface which absorbs moisture. The individual rubber block 8 may be made from recycled rubber tires, such as recycled automobile tires and/or recycled truck tires. Thus, block 8 may include various mixtures of styrene-butadiene rubber and polybutadiene rubber.

The block 8 may include a styrene-isoprene-butadiene rubber, with the rubber including repeat units which are derived from about 5 weight percent to about 20 weight percent styrene, from about 7 weight percent to about 35 weight percent isoprene, and from about 55 weight percent to about 88 weight percent 1,3-butadiene, such that the rubber has a number average molecular weight which is within the range of about 150,000 to about 400,000, wherein the rubber has a weight average molecular weight of about 300,000 to about 800,000, and wherein the rubber has an inhomogeneity which is within the range of about 0.5 to about 1.5.

Wire 12 can be referred to as a heating element, heating means, or electrical means, for example. Wire 12 can include a first heating element portion that is located inside channel 10 and a second heating element portion that is located between block 8 and power source 6. Wire 12 can be replaced by a number of wires (heating elements).

If snow falls onto block 8 and ice forms on block 8, that snow and ice will melt when the power source 6 is turned on, because electricity provided by power source 6 will be conveyed to wire 12, which will cause the temperature of wire 12 to rise, which will cause the temperature of block 8 to rise.

Figure 2:
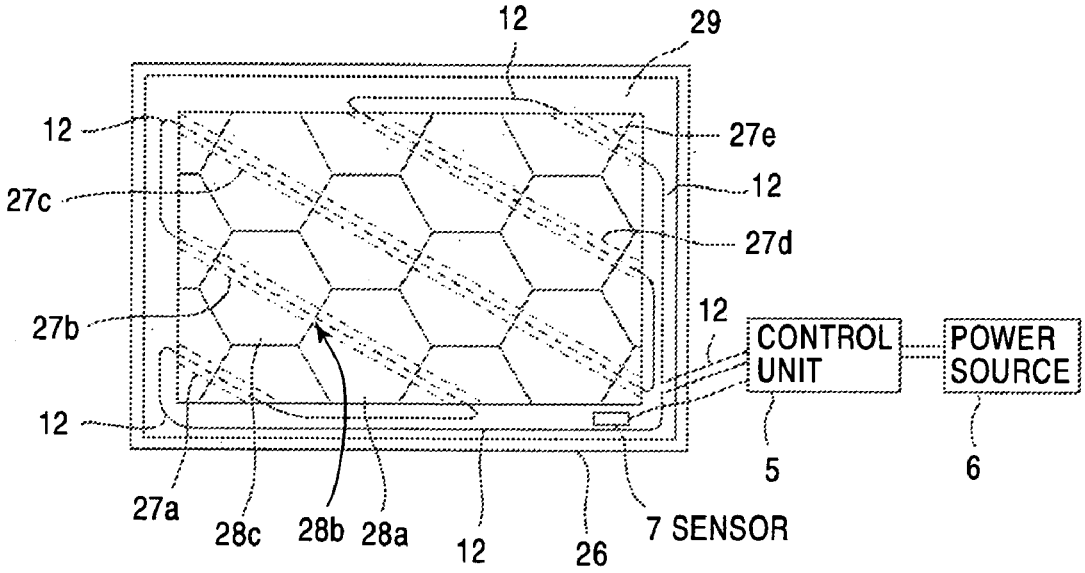
FIG. 2 shows a top view of a group of individual rubber blocks positioned together to form a rubberized covering with an integral heating system, in accordance with the principles of the present invention.

FIG. 2 shows a top view of a group of individual rubber blocks positioned together to form a rubberized covering with an integral heating system, in accordance with the principles of the present invention. The blocks 28*a* and 28*c*, and other blocks, are all positioned to fit together in a rectangular pan 26. The pan 26 can also be referred to as a frame 26 or form 26. In this manner, a rectangular mat or covering is formed. The numerous individual blocks shown in FIG. 2 can be replaced by one large block that is sized to fit into the pan 26.

The pan 26 can be placed on a top surface of a driveway, roadway, walkway, stairway, patio, porch, deck, or other surface, for example. The pan 26 can be fitted into a groove formed in a top surface of a driveway, roadway, walkway, stairway, patio, porch, deck, or other surface. The pan 26, the blocks therein, and all other components can be used indoors and outdoors.

The blocks shown in FIG. 2 can be formed to be thick and heavy, so that they will stay in place in the pan 26 without any need for fasteners or adhesive materials. Also, fasteners may be used to help to secure the blocks in pan 26. The blocks, in combination with the wire 12 and pan 26, constitute a heating system with a heated surface that is strong and durable enough to withstand a high volume of highway automobile and truck traffic, and is strong and durable enough to withstand a high volume of pedestrian traffic.

The pan 26 can be made from a variety of different materials. For example, the pan 26 may be made of any material suitable for indoor or outdoor use such as metal plastic, and/or wood. The pan 26 contains blocks 28*a*, 28*c*, and other blocks shown in FIG. 2, and is sized to receive those blocks to create an integral unit, pathway, walkway, or driving surface. The pan 26 may be referred to as a frame, form, or tray.

Each of the blocks in FIG. 2 has one channel formed through the interior of its body, similar to the way in which channel 10 is formed through the interior of block 8 shown in FIG. 1. The blocks 28*a* and 28*c* have a hexagon shape, as do some of the other blocks shown in FIG. 2. Some blocks in FIG. 2 have been cut or modified to have a variety of other shapes so that the end result is a rectangular mat in the rectangular pan 26. The blocks in pan 26 could be replaced by square blocks or blocks of other shapes. The blocks in FIG. 2 are aligned to form continuous channels 27*a*, 27*b*, 27*c*, 27*d*, and 27*e*. Wire 12 is placed through each of the continuous channels 27*a*–27*e*, and in the gap 29 adjacent to pan 26, and a power source 6 is connected to the wire 12. The power source 6 conveys electricity through the wire that is in channels 27*a*–27*e*, and thereby heats the wire 12 and all the blocks shown in FIG. 2.

Instead of one single wire 12, a plurality of wires can be used. Connectors can be used to connect a wire in one block to a wire in an adjacent block Thus, a connector can be used at junction 28*b*, to connect the wire in block 28*a* to the wire in block 28*c*. If connectors are not used, a single long continuous wire 12 can be used, with the wire being fed through all channels 27*a*–27*e*.

The channels 27*a*–27*e* can carry other electrical conductors, and are not limited to the wires described above. Metal rods or other conductors can be used in place of wire 12, for example. If metal rods are inserted into channels 27*a*–27*e* instead of the wire 12, the metal rods should be connected and arranged so that the metal rods heat up when electricity is provided from power source 6. Also, the channels 27*a*–27*e* may hold heating units other than the above-described wires and metal rods.

If snow falls onto any blocks in pan 26, that snow will melt due to the warm temperature of the blocks. In this way, the present invention will help a homeowner avoid shoveling snow. For example, the homeowner may not need to shovel the driveway if the present invention is utilized. More particularly, the homeowner may only need to flip a switch to turn on the power source 6 to heat up the group of blocks in pan 26, that comprises the top surface of a driveway or footpath. When the blocks in pan 26 are sufficiently warm, the snow and ice will melt. The homeowner does not even need to go outside, if the switch for power source 6 is located inside the home.

A sensor 7 is connected to a control unit 5, and the control unit 5 is connected to the power source 6. The sensor 7 can also be referred to as a sensing means or sensing unit. The sensor 7 can measure moisture, temperature, size, and/or other aspects of the blocks in pan 26. The blocks in pan 26 may contract due to cold temperatures and may expand due to hot temperatures.

The control unit 5 acquires the detected information from the sensor 7. There are many ways that the control unit 5 can acquire the detected information from the sensor 7. For example, the control unit 5 may read signals present at the sensor 7 to acquire the detected information. Or the control unit 5 may receive the detected information when the sensor 7 transmits that information to the control unit 5. The information can be transmitted from sensor 7 to control unit 5 through air using wireless data communication, through a fiber optic cable, through electrically conductive cable, or by other means. The wireless data communication can include a BLUETOOTH wireless data connection, a wireless fidelity (Wi-Fi) connection, or other form of wireless data communication, for example.

Based on predetermined data levels saved in a memory (not shown) in control unit 5, the power source 6 can be automatically activated. Here is one example of the operation of the control unit 5, based only on temperature level. Firstly, a user selects a threshold temperature level of 2 degrees Celsius and saves this in the memory in control unit 5. This threshold temperature level can be referred to as a predetermined temperature level. Secondly, sensor 7 detects a temperature of 1.5 degrees Celsius. Thirdly, the control unit 5 acquires the detected temperature level of 1.5 degrees Celsius. Fourthly, the control unit 5 compares the detected temperature level with the predetermined temperature level. Because 1.5 degrees is less than 2 degrees, the control unit 5 closes a switch (not shown) inside control unit 5. When the switch is closed, the power source 6 is electrically connected to wire 12, and thus power is then automatically provided from power source 6 to wire 12. Human intervention is not needed to close the switch in control unit 5, because the switch will be closed automatically by control unit 5 when the detected temperature level is less than the predetermined temperature level.

The control unit 5 can be installed in a home and can provide a user with convenient control of the heating system in the rubberized covering. The control unit 5 can display useful information, including, but not limited to, the following information: a current temperature of blocks in pan 26; a current moisture level of blocks in pan 26; current air temperature near pan 26; current humidity level near pan 26; current time; current day and date; current wind chill near pan 26; status of the heating system; and other information.

The control unit 5 can be set to provide power from power source 6 to wire 12 when a temperature level detected by sensor 7 is below 2 degrees Celsius and when a moisture level detected by sensor 7 is above a particular predetermined level, for example. Thus, when conditions seem likely to result in icy conditions, the control unit 5 will automatically close the switch and provide power from power source 6 to wire 12.

The control unit 5 can be configured to include circuitry able to detect an open circuit condition or wire 12. Thus, if wire 12 is cut or broken, the control unit 5 can detect this condition. When the wire 12 is cut, the wire 12 will no longer convey electricity along its entire length. At the location of the cut in wire 12, there will be an open circuit.

When the open circuit condition is detected, this means that the heating system is malfunctioning. The control unit 5 can notify a user of a malfunctioning heating system in one or more ways.

The control unit 5 can notify a user of a malfunctioning heating system by emitting audible and visual signals by beeping and cycling a light emitting diode on and off.

The control unit 5 can notify a user of a malfunctioning heating system by using a telecommunication device. More particularly, the control unit 5 can be connected to the telecommunication device in advance, and the control unit 5 can be configured to automatically access the telecommunication device when a cut in the wire 12 is detected. When a cut in the wire 12 is detected, the control unit 5 and telecommunication device can dial a predetermined telephone number and then play a prerecorded voice message after the telephone number is dialed. The prerecorded message could be something similar to "Malfunction detected in roadway heating system on Interstate 95 at Fairfax County Parkway." Or the prerecorded message could be something similar to "Malfunction detected in heating system in driveway."

The control unit 5 can be connected to an external data network such as the World Wide Web via the Internet in advance, and the control unit 5 can be configured to automatically send an e-mail message via the Internet to a predetermined e-mail address to notify a user of a malfunctioning heating system.

The control unit 5 can be connected to an external provider of information or services, such as the World Wide Web via the Internet. The control unit 5 can be configured to periodically receive weather reports or weather information from the external provider of information or services. When the control unit 5 receives weather information from the external provider indicating that snowy or icy conditions are coming soon, then the control unit 5 can close the switch to provide power from power source 6 to wire 12, to heat the blocks in pan 26 in advance of the snowy or icy conditions. If there is ever a problem with one block in pan 26, that one block can be replaced individually. For example, if block 28*a* becomes damaged, that one block 28*a* can be removed and a new block can be installed. The replacement of the one block 28*a* could be much less expensive than a replacement of an entire group of blocks. Also, the replacement of block 28*a* individually could be much less expensive than a replacement of the pan 26 and all its blocks. Furthermore, the replacement of block 28*a* individually could be much less expensive than a replacement of a concrete sidewalk with a heating system embedded therein.

The fact that a single block 28*a* can be replaced is one of the advantages of the present invention over a heated surface that utilizes paving materials or other materials with a heating mesh. Paving materials may include asphalt, concrete, stone, marble, masonry, and other materials, for example. A problem with a heated surface that utilizes such paving materials can be difficult, time-consuming, and expensive to resolve. For example, the paving materials and the heating system may need to be destroyed and then replaced in order to resolve the problem.

Figure 3:
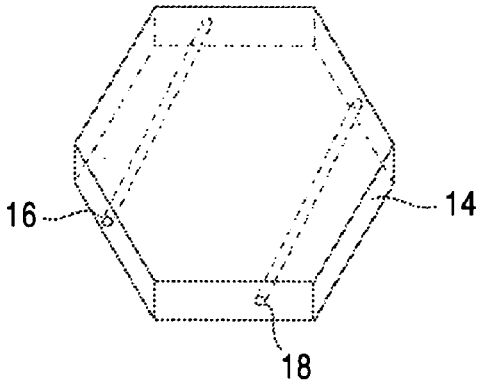
FIG. 3 shows a view of a hexagon-shaped individual rubber block with two channels through the body of the block, in accordance with the principles of the present invention.

FIG. 3 shows a view of a hexagon-shaped individual rubber block with two channels through the body of the block, in accordance with the principles of the present invention. As shown in FIG. 3, block 14 has channel 16 and channel 18. Wires may be placed in channels 16 and 18, and a power source may be connected to those wires. In this way, block 14 may heat up more quickly than block 8, because block 14 contains more inches of the wire.

Figure 4:
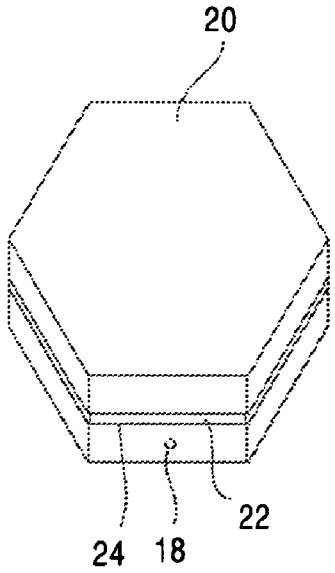
FIG. 4 shows a view of a hexagon-shaped individual molded rubber block with channels at the periphery of the block and one channel through the body of the block, in accordance with the principles of the present invention.
Figure 5:
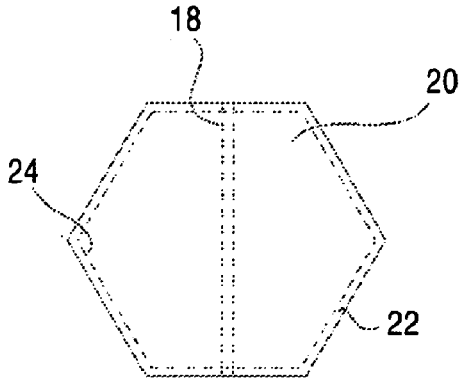
FIG. 5 shows a top view of the block shown in FIG. 4, in accordance with the principles of the present invention.

FIG. 4 shows a view of a hexagon-shaped individual molded rubber block with channels at the periphery of the block and one channel through the body of the block, in accordance with the principles of the present invention. FIG. 5 shows a top view of the block shown in FIG. 4, in accordance with the principles of the present invention.

The channel 24 is formed at the periphery of block 20, and wire 22 is inserted into channel 24. An additional wire (not shown) may be placed inside channel 18. Thus, block 20 is heated at its periphery and also at its interior.

In accordance with the principles of the present invention, a block may have more than the two through-channels 16, 18 shown in FIG. 3. Also, a block can be configured to have a channel 24 at its periphery in addition to a plurality of through-channels.

The channels 16, 18 (as well as the channels 24) need not be centered in a horizontal plane intermediately of the blocks (as shown in the drawings) and, indeed, could be on the bottom or below the blocks if desired.

Wires can be placed beneath blocks in order to heat the blocks. For example, the wires may be placed into the pan 26 before the blocks are installed, and then, when the blocks are installed, the blocks will be sitting on top of the wires. In this way, the blocks can be heated from below. The blocks that are heated from below in this manner may also have through-channels and/or a channel 24 at their periphery for additional heating power. A user of the present invention can first provide electricity to the wires below the blocks, in order to cause the blocks to reach a first temperature. If the user wants the blocks to become hotter, then the user can additionally provide electricity to the wires in the through-channels inside the blocks, in order to cause the blocks to reach a second temperature, the second temperature being hotter than the first temperature.

Figure 6:
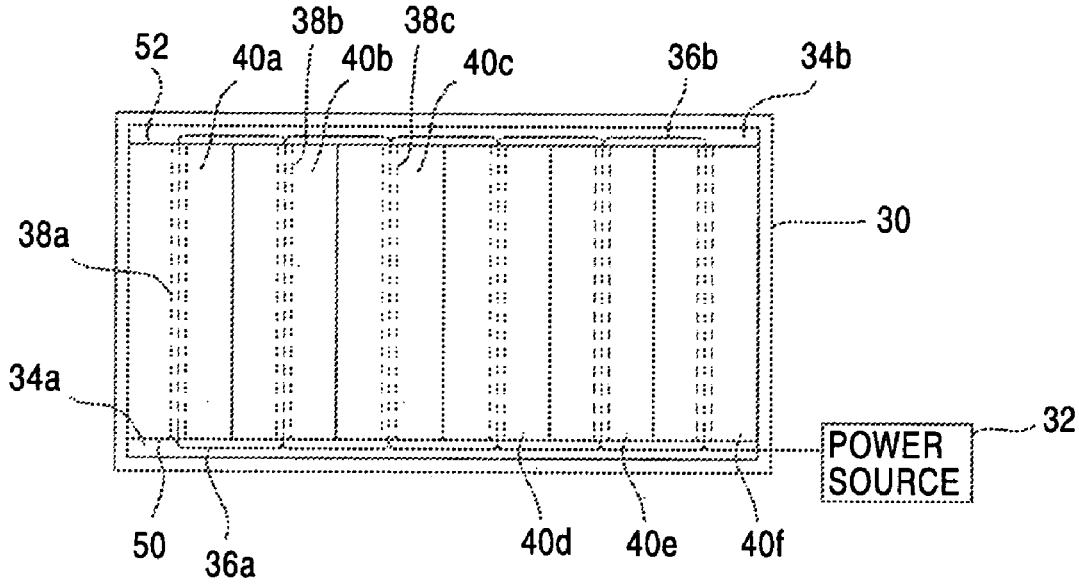
FIG. 6 shows a top view of a group of individual rubber blocks positioned together to form a rubberized covering with an integral heating system, in accordance with the principles of the present invention.
Figure 7:
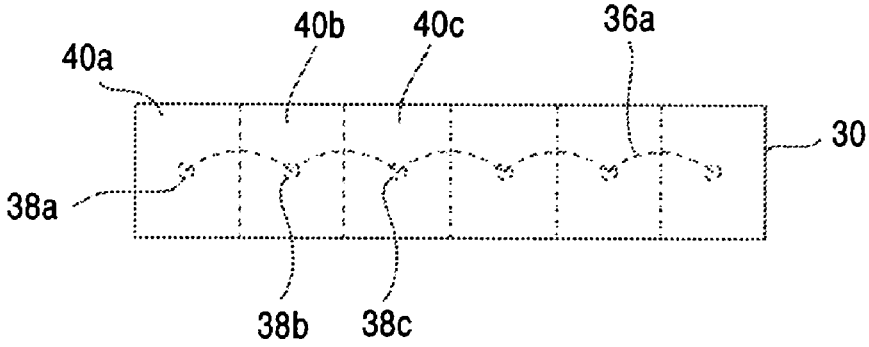
FIG. 7 shows a side view of the group of individual rubber blocks shown in FIG. 6, in accordance with the principles of the present invention.

FIG. 6 shows a top view of a group of individual rubber blocks positioned together to form a rubberized covering with an integral heating system, in accordance with the principles of the present invention. FIG. 7 shows a side view of the group of individual rubber blocks shown in FIG. 6, in accordance with the principles of the present invention.

In FIG. 6, each of the blocks 40*a*–40*f* has a rectangular shape, and each one has a single through-channel for receiving wires or metal rods or other heating elements. The blocks 40*a*–40*f* are placed in frame 30. The frame 30 may also be referred to as pan, tray, or form. The length of the blocks 40*a*–40*f* allows access gaps 34*a* and 34*b* to exist between the blocks and the frame 30. The access gaps 34*a* and 34*b* allow the wires 36*a* and 36*b* to be connected to the heating elements inside the different through-channels. Three of the through channels are identified with reference symbols 38*a*–38*c*, respectively. The access gap 34*a* allows wire 36*a* to be connected at edge 50 to the heating element in channel 38*a*. The access gap 34*b* allows wire 36*b* to be connected at edge 52 to the heating element in channel 38*a*.

If there is ever a problem with one block in frame 30, that one block can be replaced individually. For example, if block 40*a* becomes damaged, that one block 40*a* can be removed and a new block can be installed.

Figure 8:
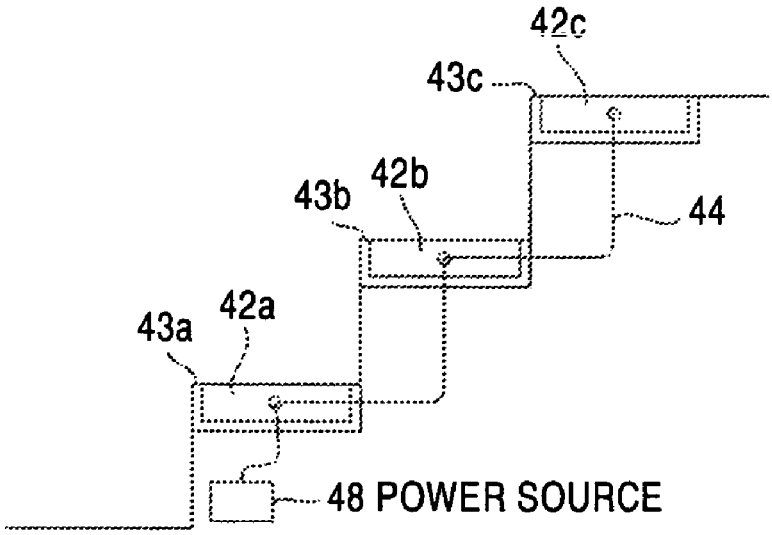
FIG. 8 shows a side view of a group of individual rubber blocks positioned on stairs to form rubberized coverings with an integral heating system, in accordance with the principles of the present invention.
Figure 9:
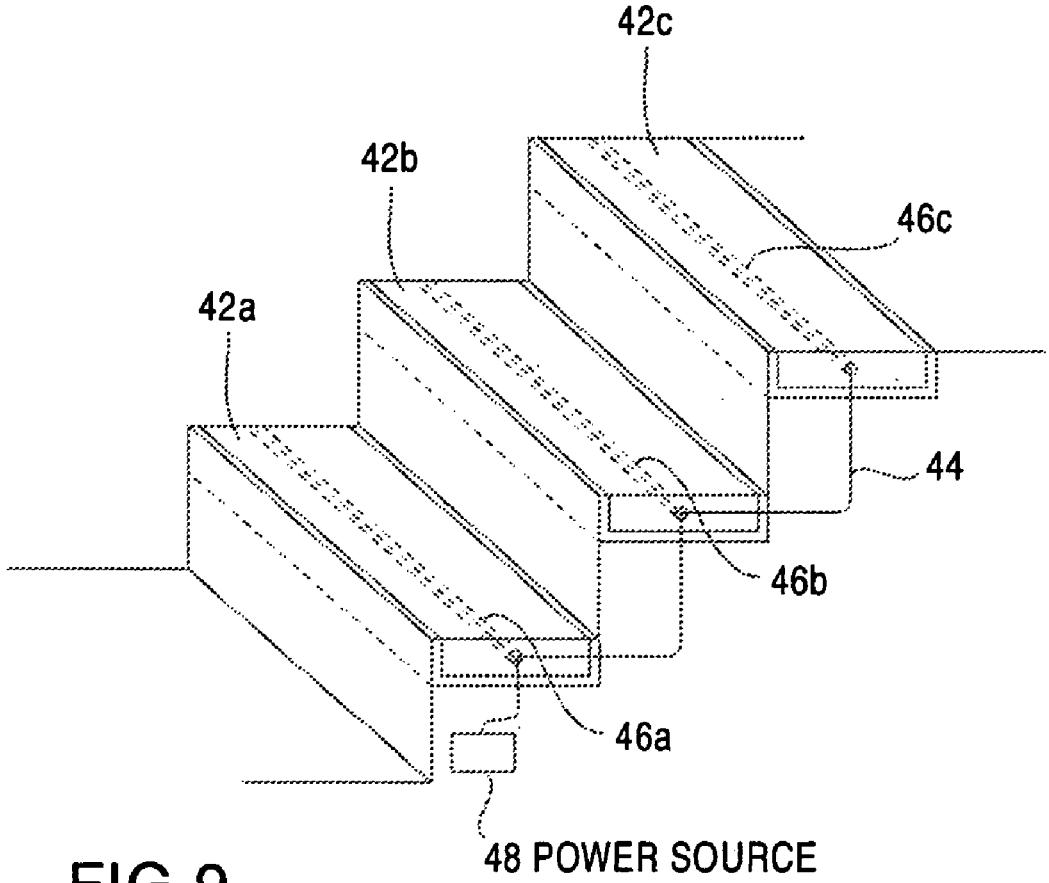
FIG. 9 shows a view of the group of individual rubber blocks shown in FIG. 8, in accordance with the principles of the present invention.

FIG. 8 shows a side view of a group of individual rubber blocks positioned on stairs to form rubberized coverings with an integral heating system, in accordance with the principles of the present invention. FIG. 9 shows a view of the group of individual rubber blocks shown in FIG. 8, in accordance with the principles of the present invention.

In FIGS. 8 and 9, each one of the blocks 42*a*–42*c* has a single through-channel 46*a*–46*c* for receiving wires or metal rods or other heating elements. The block 42*a* is placed in frame 43*a*. The block 42*b* is placed in frame 43*b*. The block 42*c* is placed in frame 43*c*. Wire 44 connects the heating elements in blocks 42*a*–42*c* with the power source 48. It will be appreciated, of course, that the blocks (with or without frames) could be the structure of the stairs themselves, consonant with the teachings of the present invention.

Figure 10:
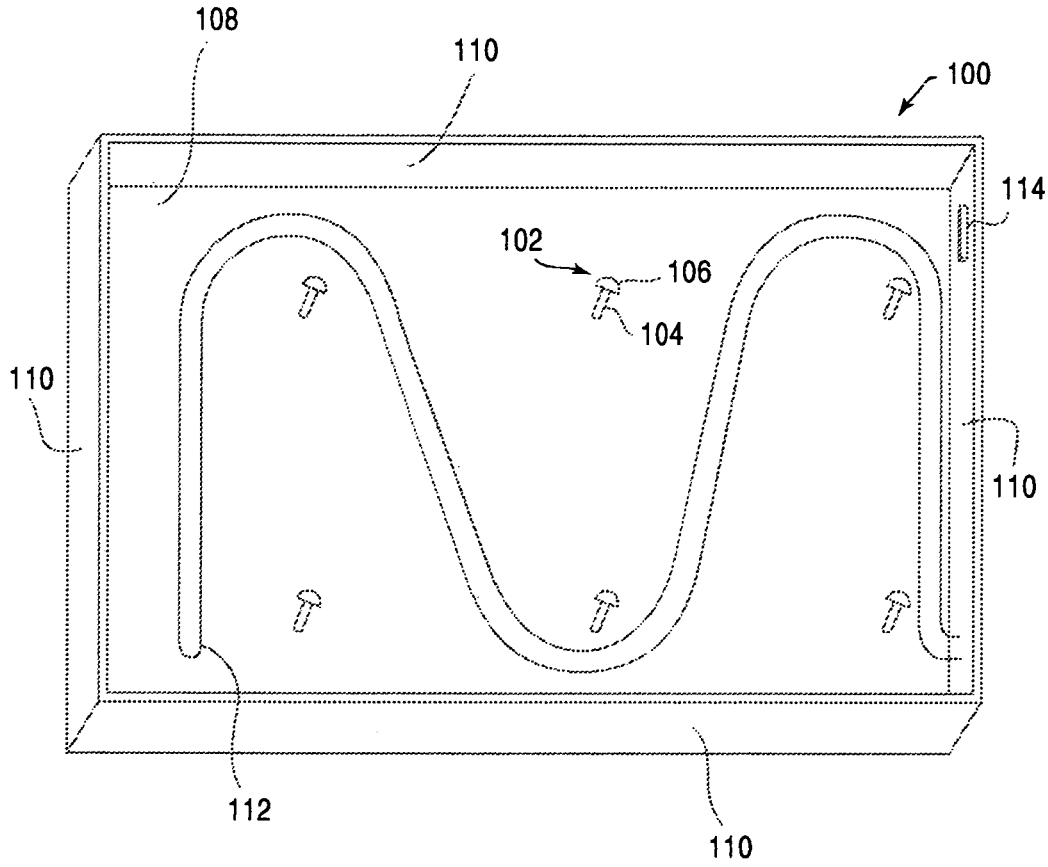
FIG. 10 shows a view of a pan before individual rubber blocks are installed, in accordance with the principles of the present invention.
Figure 11:
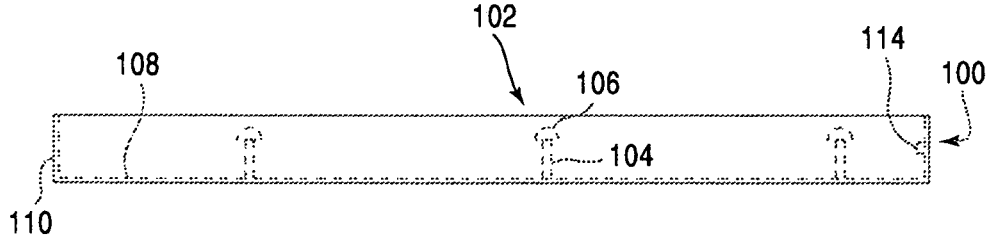
FIG. 11 shows a side view of the pan of FIG. 10, in accordance with the principles of the present invention.
Figure 12:
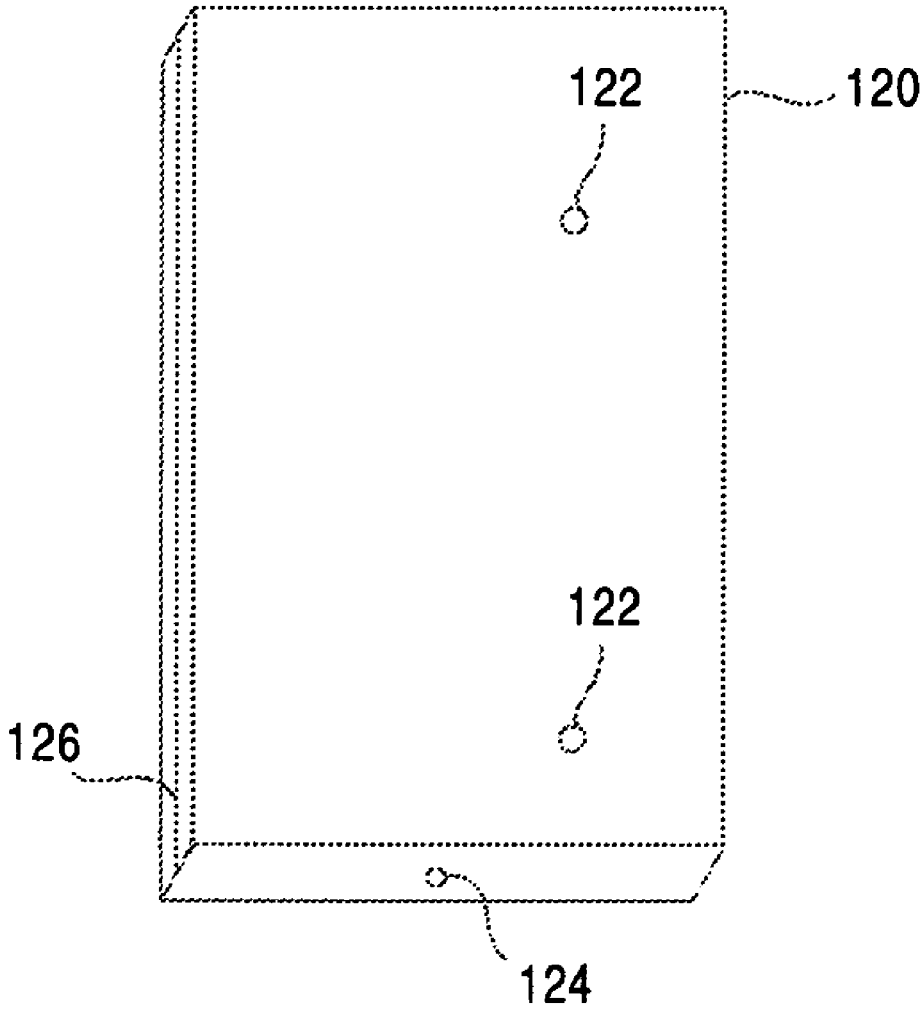
FIG. 12 shows a view of an individual rubber block which is not yet installed in the pan of FIG. 10, in accordance with the principles of the present invention.

FIG. 10 shows a view of a pan before individual rubber blocks are installed, in accordance with the principles of the present invention. FIG. 11 shows a side view of the pan of FIG. 10, in accordance with the principles of the present invention. FIG. 12 shows a view of an individual rubber block which is not yet installed in the pan of FIG. 10, in accordance with the principles of the present invention.

Figure 13:
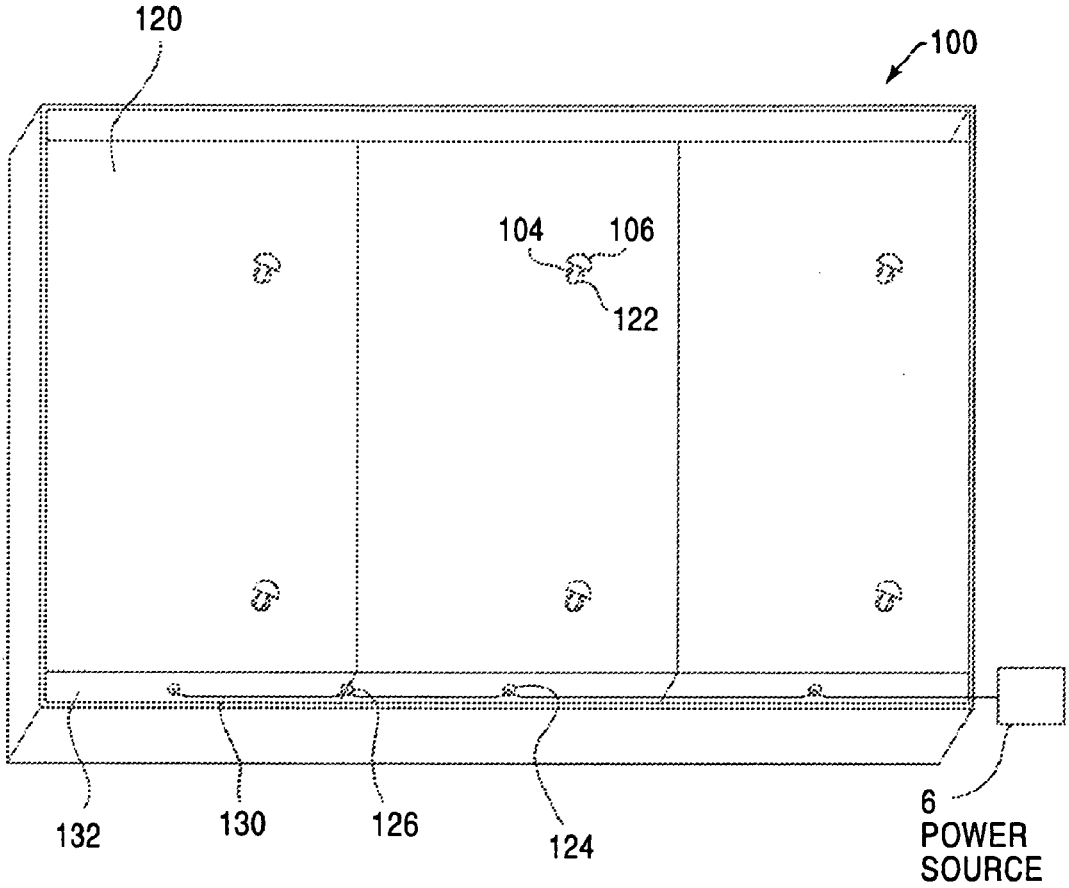
FIG. 13 shows a view of three of the blocks of FIG. 12 installed in the pan of FIG. 10, in accordance with the principles of the present invention.
Figure 14:
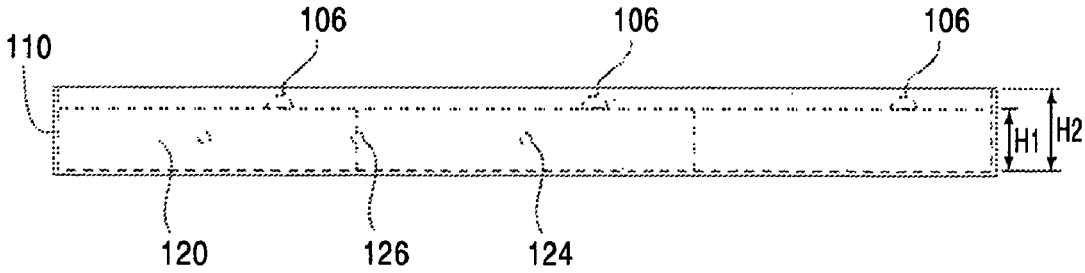
FIG. 14 shows a side view of the pan of FIG. 13, in accordance with the principles of the present invention.

FIG. 13 shows a view of three of the blocks of FIG. 12 installed in the pan of FIG. 10, in accordance with the principles of the present invention. FIG. 14 shows a side view of the pan of FIG. 13, in accordance with the principles of the present invention.

FIG. 10 shows a pan 100 which has a solid bottom interior region 108. The rubberized surface material can be placed onto the solid bottom interior region 108. The pan 100 can also be referred to as a tray, pan, or form. The pan 100 depicted has four side walls 110 which help to hold the rubberized surface material in place. Six studs 102 are secured to region 108. Each stud 102 has a stem 104 (shaft 104), and a head 106. The diameter of the head 106 is larger than the diameter of the stem 104. The wire 112 is on the bottom region 108, and the blocks 120 will be placed on top of wire 112.

FIG. 12 shows an individual rubber block 120 with a through-channel 124. The channel 124 is configured to receive a wire, metal rod, or other heating element. The channel 124 can be formed so that it will be substantially parallel to the bottom region 108 when block 120 is placed in pan 100. The channel 126 is on a periphery of block 120, and can receive heating elements.

The block 120 also includes two holes 122 (orifices 122), wherein each hole 122 is configured to receive one stud 102. The diameter of the hole 122 is larger than or equal to the diameter of stem 104. The diameter of the hole 122 is smaller than the diameter of head 106. The holes 122 can be formed such that, when blocks 120 are placed in pan 100, the holes are substantially perpendicular to bottom region 108.

The individual blocks described herein above, such as block 8 and block 120 for example, can be made of a variety of different materials. For example, the blocks can include recycled tires, including rubber and other materials. The blocks can be configured to absorb water and other liquids.

FIG. 13 shows a view of three of the blocks 120 of FIG. 12 installed in the pan 100 to form a rubberized covering with an integral heating system. The blocks 120 are on the bottom interior region 108 of pan 100, and are surrounded by the four side walls 110. The four side walls 110 enclose a space, and the blocks 120 are installed inside that space.

As shown in FIG. 14, the blocks 120 have a height H1 and each of the side walls 110 have a height H2. The height H2 is larger than the height H1. The heads 106 may protrude above blocks 120. The height H1 may typically be in the range of 1 to 2 inches, preferably 1.5 inches.

With reference to FIGS. 10–14, the rubberized covering with the integral heating system can comprise a first portion of a heating element or wire placed inside through-channel 124 in a block 120, a second portion of a heating element or wire placed inside a channel 126 at a periphery of a block 120, and a third portion of a heating element or wire placed on a bottom region 108 of pan 100. All different portions of the heating element can be connected to a power source such as power source 6 shown in FIG. 13.

In an embodiment of the present invention, pan 100 can include electrically conductive material and power source 6 can be connected to the conductive material of pan 100, such that pan 100 acts as a heating element. In this manner, pan 100 corresponds to a heating element heating blocks 120. Pan 100 can be constructed such that only the bottom region 108 is electrically conductive and thus acts as the heat source to melt snow on blocks 120. Thus, pan 100 can have a conductive portion. Here, only three different types of components would be required: blocks 120, power source 6, and pan 100, such that the electrically conductive material in pan 100 serves as the heating means.

Electrical conductors can be installed in the walls and/or bottom of pan 100, and these conductors can be used as the heating means to heat blocks 120.

The blocks 120 can be configured to have a height that equals or exceeds height H2, if preferred. If the blocks 120 absorb water or other liquids, the blocks 120 may increase in size until the water or other liquids evaporate.

A wire 130 connects the power source 6 to the heating elements installed in the channels 124 and 126 of blocks 120. The wire 130 is located in an access gap 132 near a side of pan 100. To assemble the rubberized covering with the integral heating system, as shown in FIG. 13, each block 120 is pushed down onto the bottom interior region 108 of the pan 100, with each block 120 properly aligned so that studs 102 penetrate holes 122. After the blocks 120 are pressed all the way down to region 108, the heads 106 will protrude above a top surface of each block 120. In this manner, the blocks 120 are securely held to the frame 100. However, the blocks 120 are not permanently held in the pan 100. The blocks 120 can be pulled up and out of pan 100, if necessary, when sufficient force is used, because there is flexible material in blocks 120. Thus, FIG. 13 shows blocks 120 removably positioned in pan 100.

With reference to FIG. 13, a bottom surface of block 120 faces downwards, toward the bottom interior region 108 of pan 100, and a top surface of block 120 faces upwards. Snow may fall on the top surface of block 120. The snow will melt when power source 6 provides electricity to wire 130. The pan 100 is installed on a driveway, in a groove in a driveway, on a road, in a groove in a road, on a sidewalk, in a groove in a sidewalk, or in other locations. The top surface of block 120 can be a non-skid surface which may help to prevent people from slipping and which may help to prevent vehicles from sliding out of control.

The FIG. 13 shows studs 102 used as fasteners to hold blocks 120 down in pan 100. The studs 102 are not required. Other fasteners can be used to hold blocks 120 down in pan 100. For example, a threaded shaft and a nut can be used to hold block 120 in pan 100. The diameter of the threaded shaft is equal to the diameter of stem 104, and the nut has an outer circumference which is larger than the diameter of the hole 122. The threaded shaft is secured to bottom interior region 108 of pan 100, and then, after hole 122 is penetrated by the threaded shaft, the nut is screwed onto the shaft.

A hole (not shown) can be formed in the bottom region 108 of pan 100, so that a threaded shaft will penetrate the hole in the bottom region 108 and will also penetrate the hole 122. Thus, a first nut can be screwed onto the end of the shaft closest to the top surface of the block 120, and a second nut can be screwed onto the end of the shaft closest to the bottom region 108. Other fasteners can be used such as rivets or other devices.

The blocks 120 can be secured to bottom region 108 of pan 100 using adhesive materials. An adhesive sheet backing may be laid inside pan 100 and the blocks 120 may be placed on top of the adhesive sheet.

Holes 122 and studs 102 are not always necessary. Blocks 120 can be secured to each other in pan 100 with interlocking dovetail projections and slots formed on side portions of blocks 120. The weight of the blocks 120 can help to hold the blocks down inside pan 100, thus preventing any need for holes 122, studs 102, adhesive backing, or other fasteners.

Instead of a number of blocks 120 being used, a single large sheet can be used. The single large sheet can be a molded sheet made of the same material as block 120. The single large sheet may be formed in a variety of different sizes, depending on where the rubberized covering with integral heating system of the present invention shall be utilized. The single large sheet may be about 4 feet in width, 8 feet in length, and 2 inches in height, for example. The single large sheet could have a size that corresponds to a total size of the three blocks 120 shown in FIG. 13.

Figure 15:
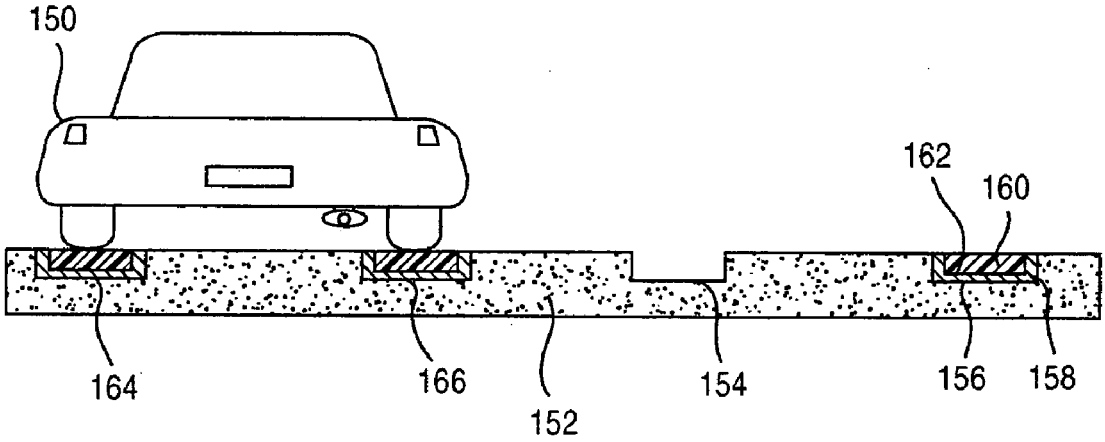
FIG. 15 shows a cross section of a driveway having rubberized coverings with integral heating systems installed, in accordance with the principles of the present invention.

FIG. 15 shows a cross section of a driveway having rubberized coverings with integral heating systems installed, in accordance with the principles of the present invention. Vehicle 150 is parked on driveway 152. Four grooves 154, 156, 164, and 166 have been formed at the top surface of the driveway 152.

Frame 158 has been installed into groove 156. The frame 156 may be referred to as a tray, pan, or form. Heating element 162 has been installed on top of a bottom region of frame 158. The heating element 162 can be a wire, metal rod, metal mesh, or other electrically conductive material. Block 160 has been positioned in frame 158 on top of heating element 162. As shown in FIG. 15, the groove 154 is empty because it has not yet been filled by any frame, heating element, or block. Each of the grooves 164 and 166 has been filled with a frame, heating elements, and blocks.

Figure 16:
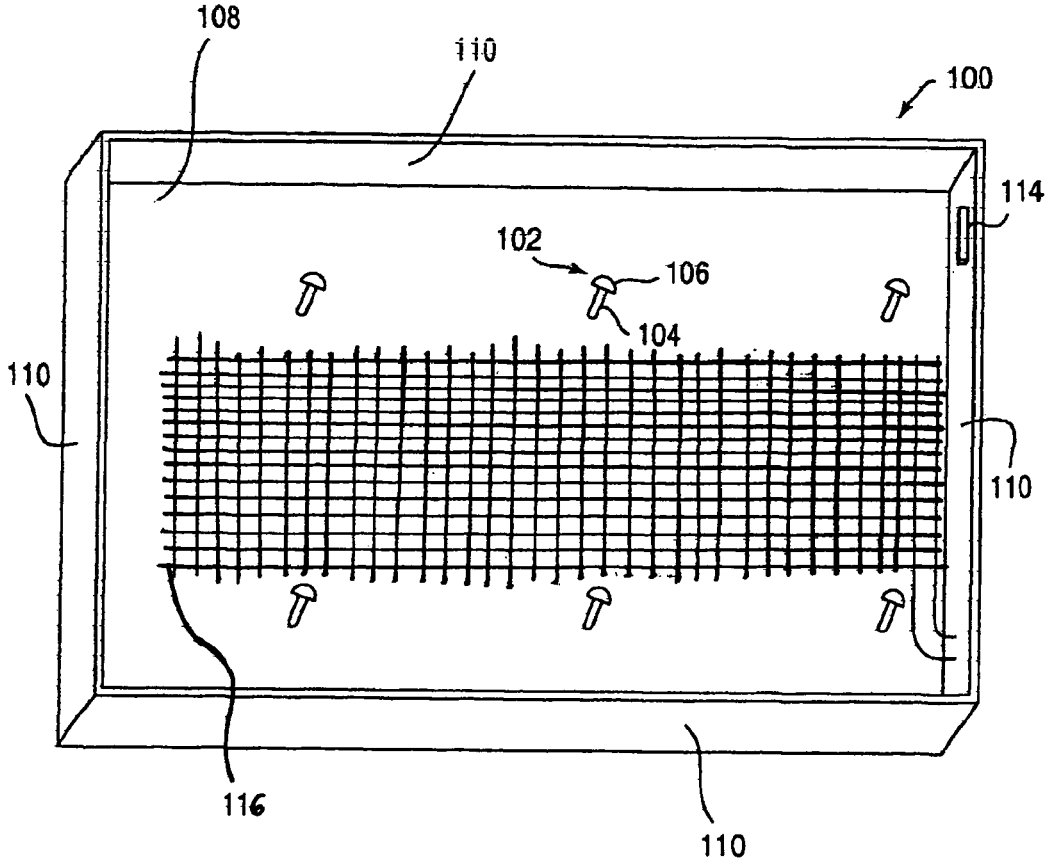
FIG. 16 shows a view of a pan before individual rubber blocks are installed, in accordance with the principles of the present invention.

FIG. 16 shows a view of a pan before individual rubber blocks are installed, in accordance with the principles of the present invention. FIG. 16 shows a pan 100 which has a solid bottom interior region 108. The rubberized surface material can be placed onto the solid bottom interior region 108. The pan 100 depicted has four side walls 110 which help to hold the rubberized surface material in place. Six studs 102 are secured to region 108. Each stud 102 has a stem 104 and a head 106. A conductive mesh 116 is on the bottom region 108, and the blocks 120 will be placed on top of the conductive mesh 116. The conductive mesh 116 can be a plurality of conductive metal rods in a mesh-formation, a plurality of conductive wires in a mesh-formation, a conductive screen, or a conductive metal mesh, for example. The conductive mesh 116 can be formed to cover the entire bottom region 108 of pan 100. Also, the conductive mesh 116 can be formed to cover only a portion of the bottom region 108 of pan 100, as shown in FIG. 16.

The sensor 7 can include a means for detecting and locating any fault in the heating means, so that a block or only a few blocks may be lifted up to provide access to the fault in the heating means for a relatively quick and convenient repair thereto.

The sensor 7 can be connected to a number of different locations along the wire 12. For example, the sensor 7 can be connected to the wire 12 at each block shown in FIG. 2. FIG. 2 shows eight complete blocks and ten partial blocks, for a total of 18 blocks. When the sensor 7 is separately connected to portions of wire 12 at each one of the 18 block regions, the sensor 7 will be able to detect an approximate location of a cut in wire 12 due to a detection of an open circuit. When this location-related information is conveyed to control unit 5, then a user will be able to find a fault or cut in wire 12 relatively quickly.

For example, a first additional wire can be connected from sensor 7 to wire 12 in the area of block 28*a*, a second additional wire can be connected from sensor 7 to wire 12 in the area of junction 28*b*, and a third additional wire can be connected from sensor 7 to wire 12 in the area of block 28*c*. If the wire 12 becomes damaged or cut at junction 28*b*, then sensor 7 will detect an open circuit at the area of junction 28*b*. When the sensor 7 detects the open circuit, detects the approximate location of the open circuit, and conveys that information to control unit 5, then the sensor 7 has functioned as a means for detecting and locating a fault in the heating means. A user can view control unit 5 and see that a fault has been detected at junction 28*b*.

Other advantages of the present invention include the following. The pan 100 can be permanently installed into a groove or indentation in a driveway. Heating elements such as wire 112 or metal rods can be installed at the bottom interior region 108 of the pan 100. The blocks 120 can be simple, inexpensive blocks formed from recycled tires. To help keep the cost of the blocks 120 low, the blocks 120 can be formed to have holes 122 but no channels. The holes 122 can be inexpensively formed using a drill. If there is ever a problem, the simple, inexpensive blocks can be removed, the wire 112 can be closely inspected and repaired, and the blocks can be replaced. A keying means 114 (FIGS. 10 and 11) can be located on a side wall of pan 100, in order to help hold blocks 120 down in pan 100.

The present invention thus provides an improved covering and a heating system for an existing driveway, walkway, patio, steps or the like; one that is quick, easy and convenient to install, provides ready access for any necessary repairs, and is economical for widespread marketing. Moreover, the present invention provides superior drainage together with an improved heat transfer coefficient (rubber vs. concrete or asphalt) for faster melting of the ice and snow; and these are additional features and advantages of the present invention.

While the invention has been described in conjunction with various embodiments, they are illustrative only. Accordingly, many alternative, modifications and variations will be apparent to persons skilled in the art in light of the foregoing detailed description. For example, the blocks may take any particular geometrical shape (or size). The foregoing description illustrates some alternatives and variations falling with the spirit and broad scope of the appended claims. While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit and scope of the applicant's general inventive concept.

What is claimed is:

1. In combination, a heated driveway, walkway, patio, deck, or stairs principally for outdoor use but usable as well for indoor use, the combination comprising a pan anchored to an existing surface, at least one insulating block disposed within the pan, the block being molded principally of recycled rubber, thereby providing a frictional surface to prevent or minimize slipping, and electrical heating means disposed between the block and the pan, thereby providing substantially improved moisture absorption and evaporation along with substantially improved melting capacity for ice or snow, and the block being removably disposed in the pan, whereby the block can be lifted out of the pan for substantially easier and convenient access to the electrical heating means, thereby avoiding the necessity for digging up any concrete or masonry materials.

2. The combination of claim 1, further comprising keying means between the at least one block and the pan, thereby retaining the at least one block laterally in the pan.

3. The combination of claim 1, wherein the electrical heating means comprises a conductive mesh.

4. The combination of claim 1, wherein the electrical heating means comprises conductive wires.

5. The combination of claim 1, wherein the at least one block comprises a plurality of blocks arranged in a pattern.

6. The combination of claim 5, further including means for detecting and locating any fault in the electrical heating means, so that a block or a few blocks can be lifted up to provide access to the fault in the electrical heating means for a relatively quick and convenient repair thereto.

7. The combination of claim 1, wherein the block comprises a molded sheet.

8. The combination of claim 1, further including a plurality of blocks arranged in a pattern.

9. A non-slip heated driveway, walkway or patio, comprising a pan anchored to an existing driveway, walkway or patio, a heating means laid in the pan, at least one block laid in the pan over the heating means and separate therefrom, such that the heating means is sandwiched between the block and the pan and is not physically connected to the block or pan, keying means between the pan and the block, thereby retaining the block against substantial lateral movement of the block within the pan, the block having an upper non-slip surface for pedestrian safety, yet accommodating vehicular travel thereon, and the heating means melting snow or ice accumulating on the block, whereby in the event of a failure of the heating means, the block can be simply lifted up and out of the pan the keying means, thereby providing convenient and ready access to the heating means for repair or replacement thereof.

* * * * *